US006283795B1

(12) United States Patent
Chen

(10) Patent No.: US 6,283,795 B1
(45) Date of Patent: Sep. 4, 2001

(54) ELECTRICAL CONNECTOR WITH REDUCED ATTENUATION, NEAR-END CROSS TALK, AND RETURN LOSS

(75) Inventor: Michael Chen, Taipei (TW)

(73) Assignee: Surtec Industries Inc., Taipei (TW)

( * ) Notice: Subject to any disclaimer, the term of this patent is extended or adjusted under 35 U.S.C. 154(b) by 0 days.

(21) Appl. No.: 09/524,588

(22) Filed: Mar. 14, 2000

(51) Int. Cl.[7] ..... H01R 24/00
(52) U.S. Cl. ..... 439/676; 439/941
(58) Field of Search ..... 439/676, 941, 439/620

(56) References Cited

U.S. PATENT DOCUMENTS 4,726,638 * 2/1988 Farrar et al. ..... 439/620
5,310,363 * 5/1994 Brownell et al. ..... 439/676
5,470,244 * 11/1995 Lim et al. ..... 439/189
5,547,405 * 8/1996 Pinney et al. ..... 439/894
6,132,260 * 10/2000 Wu ..... 439/676

* cited by examiner

*Primary Examiner*—Tulsidas Patel
*Assistant Examiner*—Brian S. Webb
(74) *Attorney, Agent, or Firm*—Birch, Stewart, Kolasch & Birch, LLP

(57) ABSTRACT

An electrical connector comprises a base, a conductor seat, a spring contact, and a circuit board. The wiring of that circuit board is that the board has the first and second conductors extended from aperture on the top surface through the board to the bottom. Also, the first and second conductor sections are unshielded on top of the board in contact with the third and sixth pins respectively when the spring contact is secured between the conductor seat and the board. Further, the first and second conductors are below the board extended along above the fourth and fifth pins of the contact spring through the third and fourth conductor sections on the board. Finally, the first and second conductors are in contact with the vertical portions of the third and sixth pin of the spring contact respectively.

5 Claims, 5 Drawing Sheets

ELECTRICAL CONNECTOR WITH REDUCED ATTENUATION, NEAR-END CROSS TALK, AND RETURN LOSS

BACKGROUND OF THE INVENTION

1. Field of Invention

The present invention relates to an electrical connector, and more particularly to an electrical connector with reduced attenuation, near-end cross talk, and return loss so as to achieve impedance matching and comply with Category 5e of EIA/TIA T568A standard.

2. Related Art

Recently, the quality of electrical lines are required to be sufficiently high in order to meet with the high performance standard of data transmission in the network based communication systems. Moreover, the quality of electrical connectors is also required to enhance in order to meet with the even higher transmission speed. Conventionally, a network communication path consists of a transmission medium and a plurality of electrical connectors. Such transmission medium can be a twisted pair, a coaxial cable, an optical fiber, and so on. Nevertheless, such a network communication path experiences a number of drawbacks, particularly at higher frequencies in the network communication systems, thus degrading the signal quality. The drawbacks can be classified as follows:

1) Attenuation. Attenuation is a phenomenon of reducing the strength of an electrical signal, which becomes severe as the transmission distance increases.
2) Near-end cross talk. Near-end cross talk (NEXT) is a phenomenon that occurs when two signal lines carrying signals with about the same frequency in close proximity to each other causes the frequency of one line to interfere with that of the other.
3) Return loss. Return loss is a phenomenon when discontinuous impedance in the transmission system occurs, in turn causes a reflection in the electrical lines, and thus consumes power.

In the case of Unshielded Twisted Pair (UTP) lines, consisting of two insulated copper lines, are twisted in a predetermined manner. Typically, a twisted pair of line consists of a communication link. Alternatively, two pairs of lines consist of a communication link in some cases. These are simple transmission media commonly employed in computer networks. However, cross talk is found in the transmission media due to capacitive coupling existing between the lines. This cross talk is particularly obvious in higher transmission rate (or bit rate). Cross talk also increases impedance as well as significantly attenuates high frequency signals.

Accordingly, Electronic Industries Association (EIA) and Telecommunication Industries Association (TIA) propose a number of standards. These standards are accepted by Institute of Electrical and Electronic Engineers (IEEE). For example, the EIA/TIA T568A standard is included in the 802.3u standard. The EIA/TIA T568A standard is set out to require that the characteristics of all transmission media and electrical connecting means comply with the limits in accordance with the specifications as well as provide a number of standards for each category. For instance, Category 3 is set out to regulate voice signal lines where the bandwidth is 16 Mbps for 24AWG copper line and 100Ω impedance. Category 4 and Category 3 are the same except that the former has an allowable bandwidth of 20 Mbps. Category 5 and Category 3 are the same except that the former has an allowable bandwidth of 100 Mbps. As to Category 5e standard with respect to electrical lines, it aims at regulating limits for improving the phenomenon of discontinuous impedance in the transmission medium, and reflection and power loss caused therefrom. In brief, Category 5e has stricter limits than Category 5 with respect to return loss.

A perspective view of a prior art for the electrical connector is shown in FIG. 1 comprising a base 10, a conductor seat 12, and a base plate 13. It is claimed by such prior art that the combination of media and connectors comply with the limits in accordance with corresponding specifications. However, for example, even if the combination of them complies with Category 5e respectively, each of them does not. Element by element, such prior art for electrical connectors is not electrical devices in compliance with Category 5e. Thus, signal quality is degraded in transmission when such electrical connectors are used.

Thus, it is desirable to provide an electrical connector with reduced attenuation, near-end cross talk, and return loss in order to overcome the above drawbacks of prior art.

SUMMARY OF THE INVENTION

It is therefore an object of the present invention to provide an electrical connector for reducing attenuation, near-end cross talk, and return loss occurring in signal transmission of network communication systems in order to comply with Category 5e of the EIA/TIA T568A standard.

The advantages of the present invention are realized by providing an electrical connector comprising a base, a conductor seat, a spring contact, and a circuit board. It is possible that the above problems of attenuation, near-end cross talk (NEXT), and return loss caused by the increase of frequency in network communication systems can be eliminated or substantially reduced by configuring the wiring of metal conductors on the circuit board of the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become fully understood from the detailed description given hereinbelow by illustration only, and thus is not limitative of the present invention, and wherein.

DETAILED DESCRIPTION OF THE INVENTION

Figure 2:
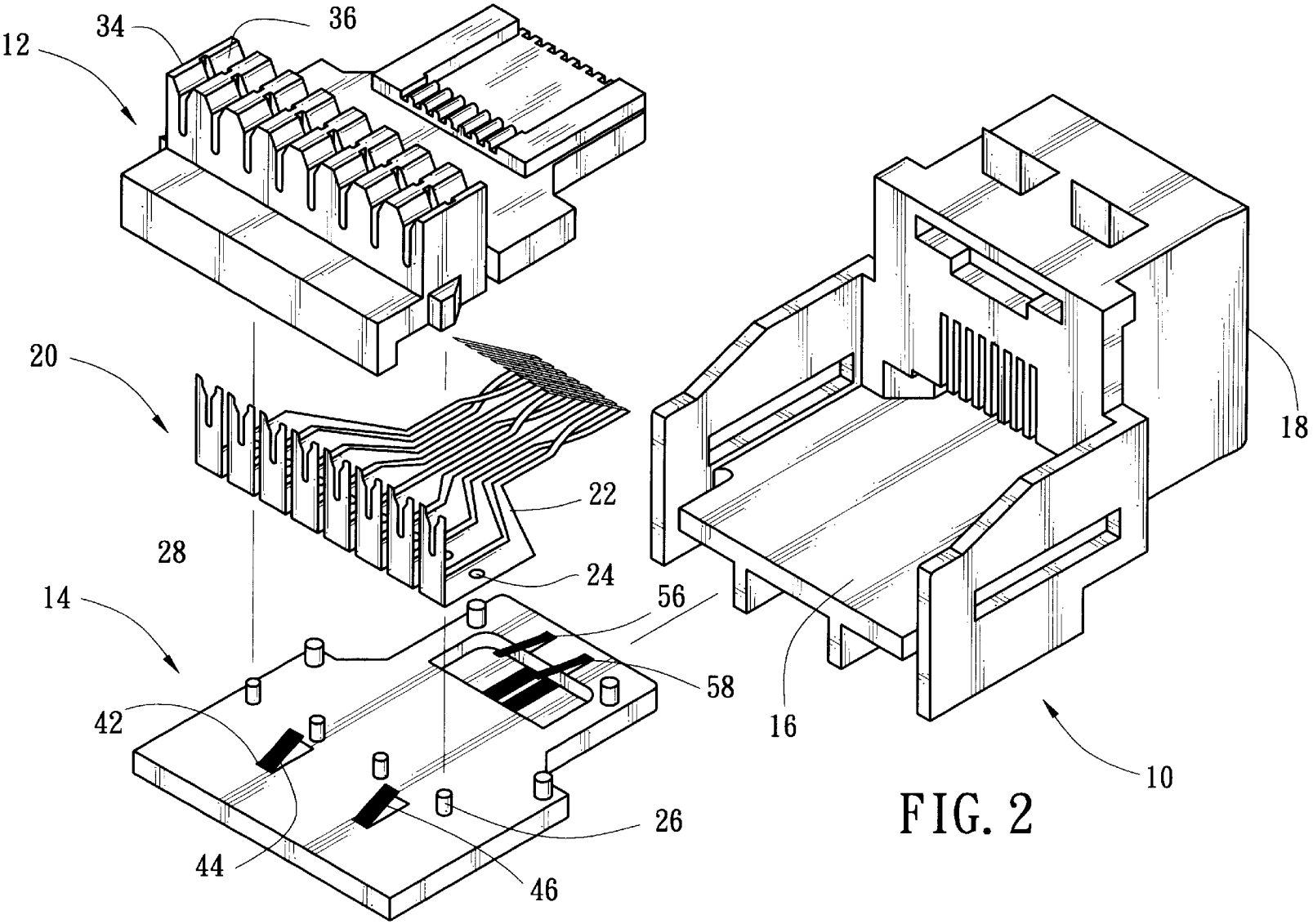
FIG. 2 is a perspective view of a preferred embodiment of electrical connector according to the invention.
Figure 5:
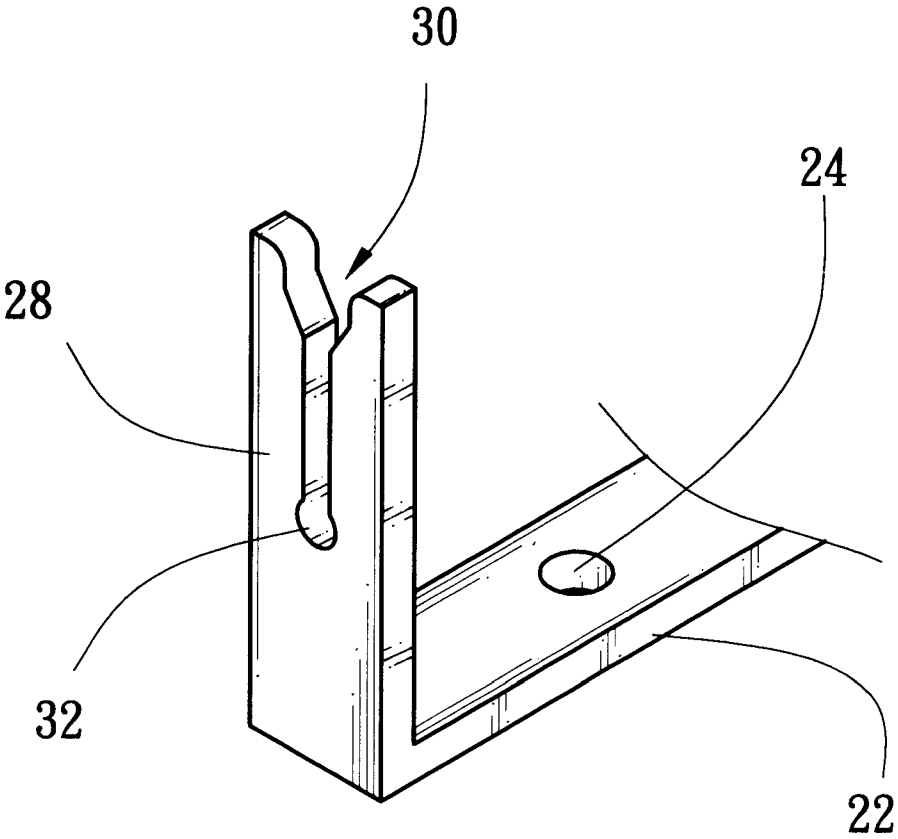
FIG. 5 is a perspective view detailing a portion of the pin of the invention.

Referring to FIGS. 2 and 5, there is shown an electrical connector constructed in accordance with the invention comprising a base 10, a conductor seat 12, and a circuit board 14. The characteristic of the invention is that the return loss problem can be solved by attaching the circuit board 14 with the conductor seat 12 together using the novel technique of the invention in order to comply with Category 5e standard regarding electrical lines. The following is a detailed description of each above component.

The base 10 as shown in FIG. 2 has a wire-receiving seat 16 in the front side and a receptacle 18 in the rear side. A spring contact 20 is provided at the wire-receiving seat 16 being secured by the conductor seat 12 and the circuit board 14. These three assembled components (i.e., conductor seat 12, spring contact 20, and circuit board 14) are inserted in the wire-receiving seat 16 in order to be secured to the base 10.

The spring contact 20 comprises a plurality of bent pins 22 with one end inserted into the receptacle 18 being electrically connected thereto. Each pin 22 has an aperture 24 for allowing the post 26 to insert through. The pin 22 also has a vertical portion 28 in the front end. The vertical portion 28 has a wire strand slot 30 (FIG. 5) open to the top and a circular hole 32 in the bottom of the wire strand slot 30. In use, the wire strand is inserted in the wire strand slot 30 until being secured in the hole 32.

The conductor seat 12 has a plurality of protrusions 34. Every two adjacent protrusions 34 have an insulated slot 36 formed therebetween. Vertical portions 28 of pins 22 of the spring contact 20 are inserted into the insulated slots 36 through the bottom of the conductor seat 12.

Figure 1:
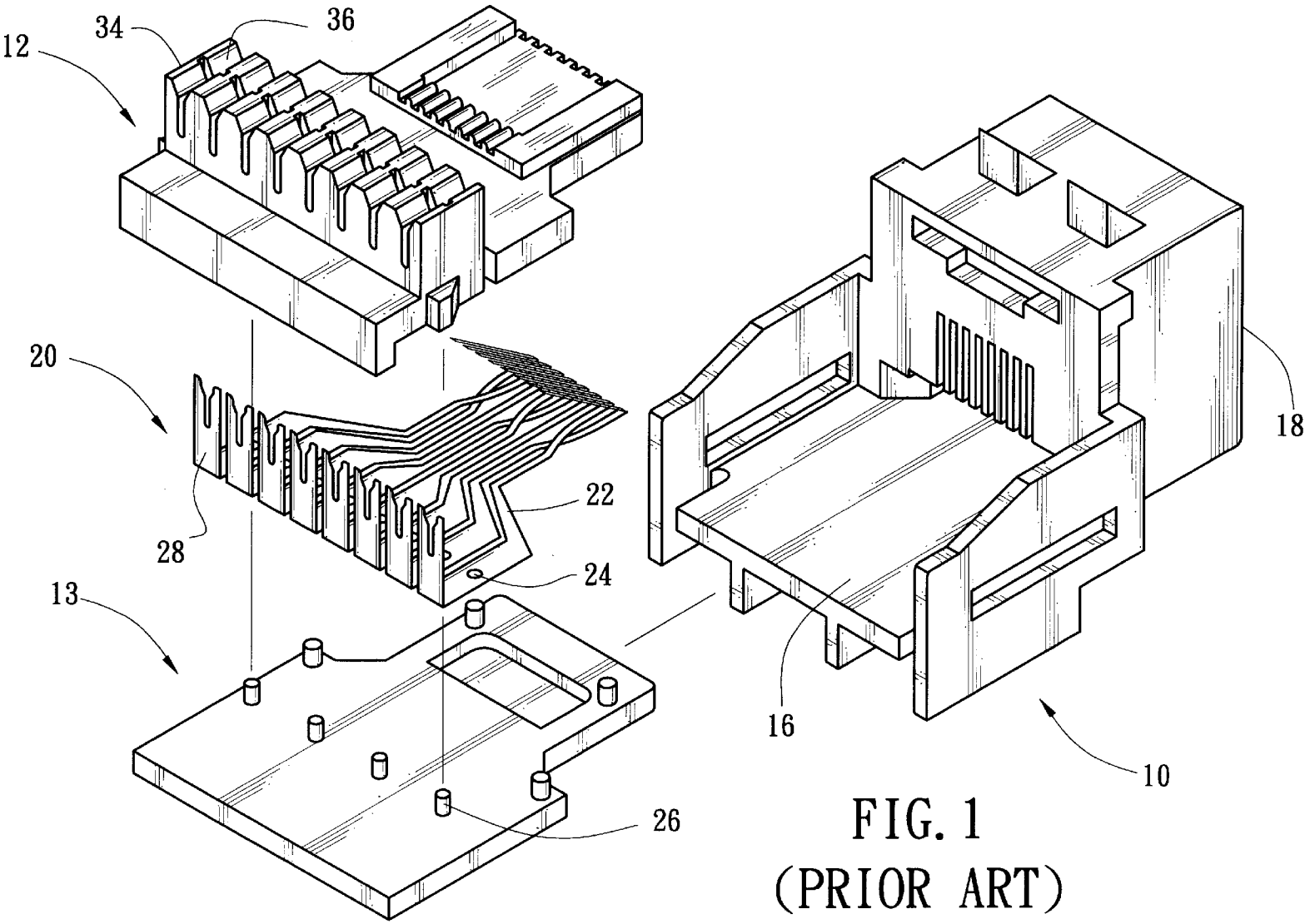
FIG. 1 (PRIOR ART)
FIG. 1 is a perspective view of a prior art for electrical connectors.

The characteristic of the invention is the novel design of the circuit board 14. In the design of the prior art (FIG. 1), a plurality of posts 26 are provided on a planar plate for allowing apertures 24 of pins 22 of the spring contact 20 to put on so as to secure the spring contact 20 and the planar plate together. In comparison, for the sake of complying with Category 5e standard regarding electrical lines, a circuit board 14 is used by the invention in replacement of the above planar plate. Further, a novel wiring is introduced in the circuit board 14 so as to reduce return loss. The wiring of the circuit board 14 is detailed below.

Figure 3B:
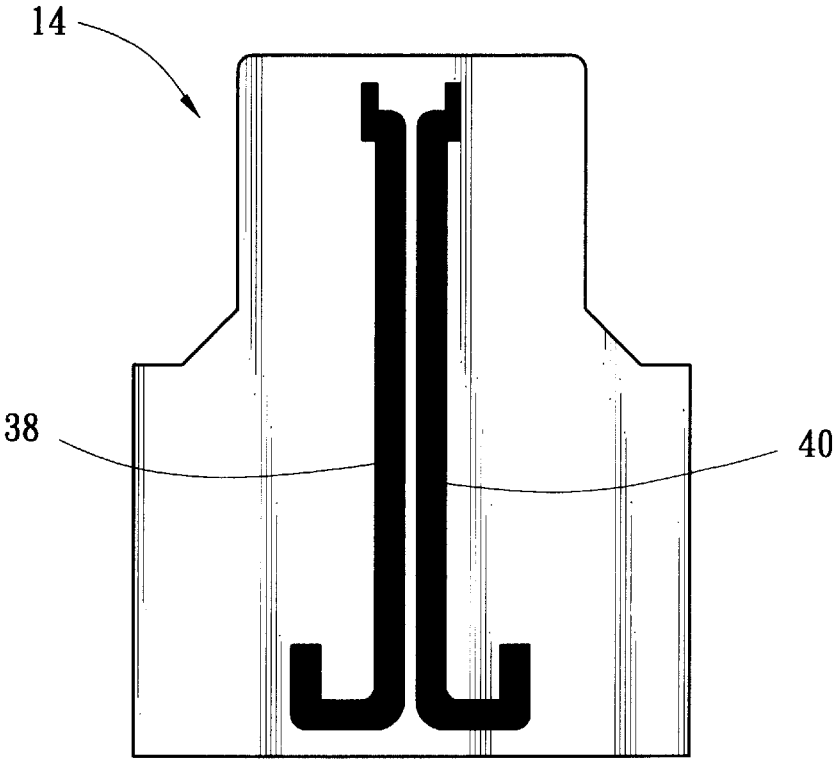
FIG. 3B is a bottom plan view of the circuit board of FIG. 2 showing the wiring of metal conductors thereon.
Figure 3A:
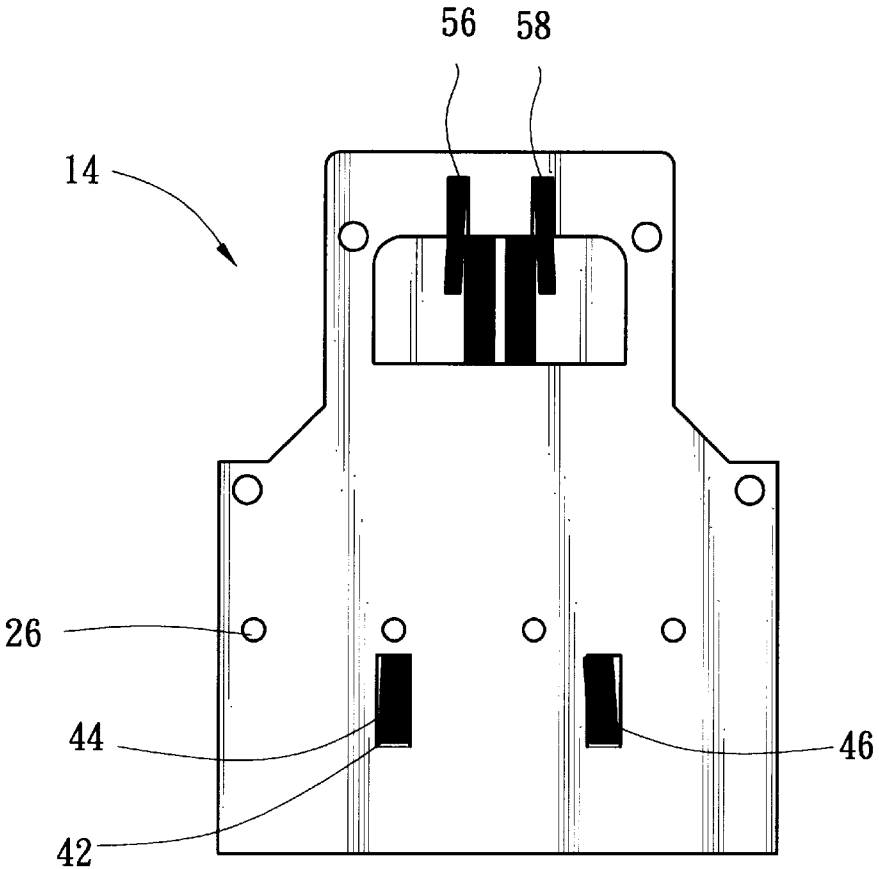
FIG. 3A is a top plan view of the circuit board shown in FIG. 2.
Figure 4:
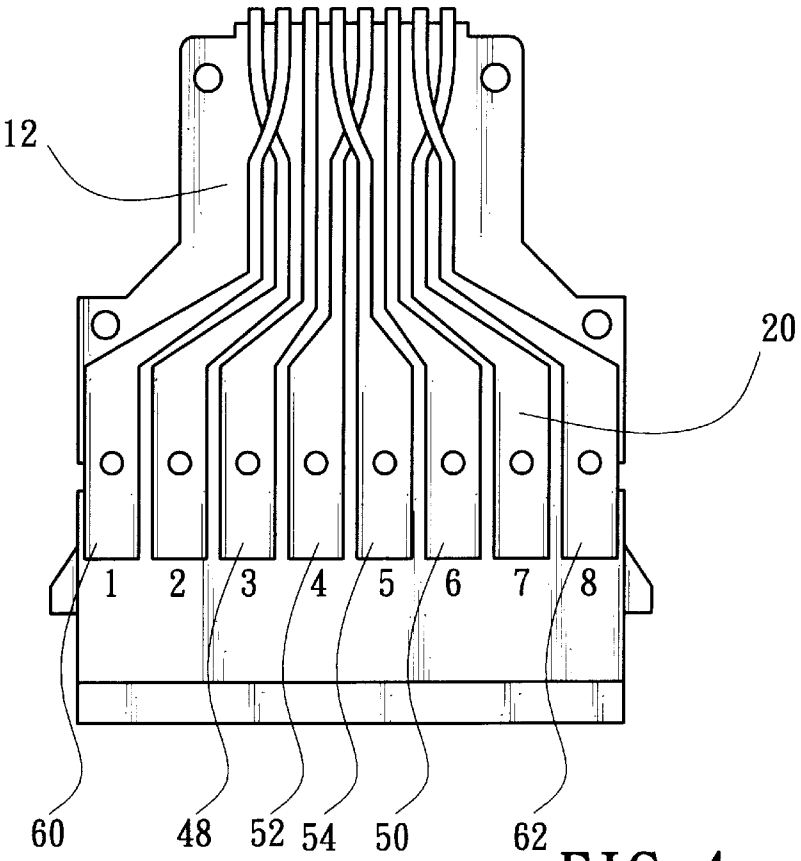
FIG. 4 is a bottom plan view of pin arrangement of the conductor seat of the invention.

Referring to FIGS. 3A, 3B, and 4, the circuit board 14 is shown as a rectangular plate with the top side protruded (FIG. 3A). As stated above, posts 26 are provided on the circuit board 14 for inserting through apertures 24 of the spring contact 20 and slots 36 of the conductor seat 12. Further, there are first metal conductor 38 and second metal conductor 40 extended from the aperture 42 on the top surface through the circuit board 14 to its bottom of (FIG. 3B). As shown, the first conductor section 44 and second conductor section 46 are unshielded on top of the circuit board 14. First and second conductor sections 44 and 46 are in contact with the third pin 48 and sixth pin 50 when the spring contact 20 is secured between the conductor seat 12 and the circuit board 14 (FIG. 4). As to the wiring, first and second metal conductors 38 and 40 are above the fourth pin 52 and fifth pin 54 with the circuit board 14 located therebetween. Further, first and second metal conductors 38 and 40 are extended through the aperture 42 on the other side to pass through the circuit board 14 to its top. Note that the third and fourth conductor sections 56 and 58 on top of the circuit board 14 are in contact with the horizontal portions of third pin 48 and sixth pin 50 respectively. As a result, a good electrical contact is maintained, thereby achieving a better signal quality. It is appreciated by those skilled in the art that a double-side printed wiring on the circuit board may be implemented in replacement of the single-side wiring thereof.

Figure 3C:
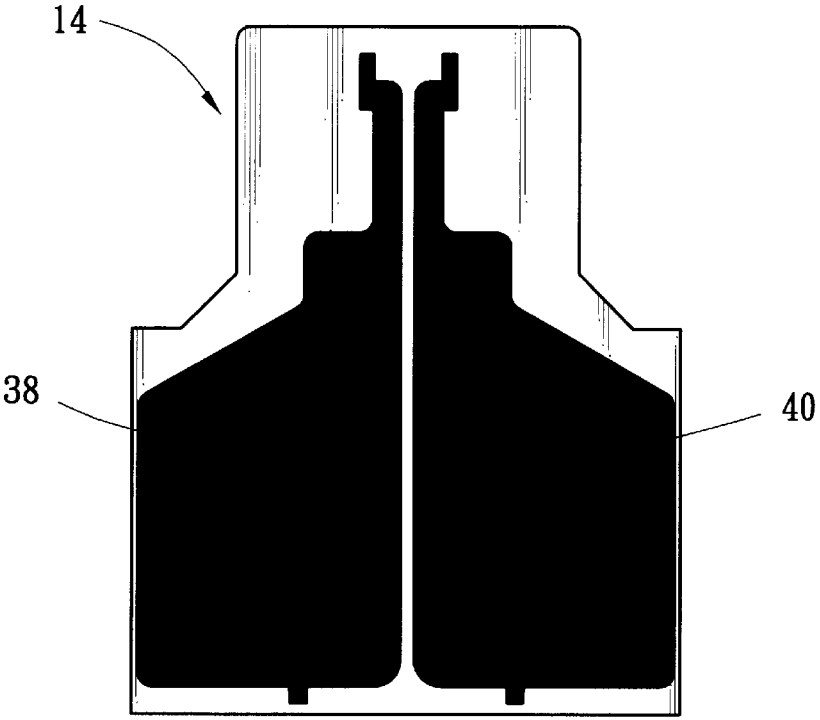
FIG. 3C is similar to FIG. 3B, showing another preferred embodiment of the circuit board.

Another preferred embodiment of the wiring on the circuit board 14 is shown in FIG. 3C. As shown, the wiring of first and second metal conductors 38 and 40 are from above the fourth pin 52 and fifth pin 54 with the circuit board 14 located therebetween. First and second metal conductors 38 and 40 then extend from the first pin 60 and eighth pin 62 through the aperture 42 on the other side to pass through the circuit board 14 to its top. Note that the third and fourth conductor sections 56 and 58 on top of the circuit board 14 are in contact with the horizontal portions of the third pin 48 and sixth pin 50 respectively. This connection also complies with Category 5e standard with respect to electrical lines.

Attenuation, near-end cross talk, and return loss measured in cable being attached to electrical devices through the electrical connectors of the invention under an environment of room temperature 23° C. are detailed in Table I (forward test of the invention) and Table II (reverse test of the invention) respectively.

TABLE I

| Frequency (MHz) | Return loss (db) |
|---|---|
| 1 <= f < 10 | 19 + 3*LOG(f) |
| 10 <= f < 20 | 22 |
| 20 <= f <= 100 | 22 − 7*LOG(f/20) |

TABLE II

| Frequency (MHz) | Return loss (db) |
|---|---|
| 1 <= f < 25 | 30 |
| 25 <= f <= 100 | 18 − 20*LOG(f/100) |

Based on the above tables, it is tested and found that the electrical connectors of the invention comply with Category 5e of EIA/TIA T568A standard with respect to electrical lines.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electrical connector comprising:

a base having a wire-receiving seat in one side and a receptacle in the opposite side;

a conductor seat;

a circuit board; and a spring contact including a plurality of continuous, unbroken bent pins with a vertical portion and a horizontal portion, with the spring contacts being clamped between the conductor seat and the circuit board so that the spring contact, the conductor seat, and the circuit board are received in the wire-receiving seat to be secured to the base;

the circuit board having a wiring comprising a first metal conductor and a second metal conductor with a first conductor section and a second conductor section exposed on the top of the board in one side, and a third conductor section and a fourth conductor section exposed on the top of the board in the opposite side; the first metal conductor being located below the board attaching to the first and the third conductor sections; the second metal conductor being located below the board attaching to the second and the fourth conductor sections; the first and the second conductor sections being in contact with a third and a sixth pins respectively; the first and second metal conductors on the bottom of the board being above a fourth and a fifth pins respectively; and the third and the fourth conductor sections being in contact with the horizontal portions of the third and the sixth pins respectively.

2. The electrical connector of claim 1, wherein the first and second metal conductors are extended from above the fourth and the fifth pins through the first and an eighth pins together through the board in the opposite side to the top of the board.

3. The electrical connector of claim 1, wherein the wiring on the circuit board is implemented in a circuit board with double-side printed wiring.

4. The electrical connector of claim 1, wherein the first metal conductor and the second metal conductor are spaced from and free of contact with one another.

5. The electrical connector of claim 1, wherein the connector complies with Category 5e of EIA/TIA T568A standard.

* * * * *